US005113969A

United States Patent [19]

Drolet et al.

[11] Patent Number: 5,113,969

[45] Date of Patent: May 19, 1992

[54] DISPLACEABLE WORKING PLATFORM WITH EXTENSIBLE BOOM

[75] Inventors: Luc Drolet, Cap-Rouge; Paul Michaud, Ancienne-Lorette, both of Canada

[73] Assignee: Centre de Recherche Industrielle du Quebec, Sainte-Foy, Canada

[21] Appl. No.: 698,113

[22] Filed: May 10, 1991

[51] Int. Cl.[5] ..... B66F 11/04; E21B 7/00

[52] U.S. Cl. ..... 182/2; 182/82

[58] Field of Search ..... 182/2, 82, 141, 63; 299/33

[56] References Cited

U.S. PATENT DOCUMENTS

| | | | |
|---|---|---|---|
| 1,987,982 | 1/1935 | Wheeler | 299/33 |
| 2,176,885 | 10/1939 | Cadwallder | 299/33 |
| 2,194,466 | 3/1940 | Cadwallder | 299/33 |
| 3,113,661 | 12/1963 | Linke | 299/33 |
| 3,153,510 | 10/1964 | Brannfors | 182/2 |
| 3,610,367 | 10/1971 | Atchey | 182/2 |
| 3,809,180 | 5/1974 | Grove | 182/2 |
| 3,840,128 | 10/1974 | Swoda | 182/2 |
| 3,907,366 | 9/1975 | Pender | 299/33 |

FOREIGN PATENT DOCUMENTS

| | | |
|---|---|---|
| 989814 | 5/1976 | Canada . |
| 2000107 | 4/1990 | Canada . |

*Primary Examiner*—Reinaldo P. Machado

*Attorney, Agent, or Firm*—Oblon, Spivak, McClelland, Maier & Neustadt

[57] ABSTRACT

A displaceable working platform comprising a main frame having stabilizing extension posts secured thereto for immovably securing the main frame to surrounding surfaces. A displaceable platform is slidingly secured to the main frame. The platform is displaceable on the main frame from a storage position to a working position. An extensible boom is secured on a rotating support base which is secured to the displaceable platform. The boom has a working free end at which a working element is secured. The rotating support base is rotatable by a motor and a boom is extensible by an hydraulic system which is also provided to regulate the angular position of the boom by controlling hydraulic pistons connected between the boom telescopic sections, and the rotating support base.

15 Claims, 5 Drawing Sheets

DISPLACEABLE WORKING PLATFORM WITH EXTENSIBLE BOOM

BACKGROUND OF INVENTION

1. Field of the Invention

The present invention relates to a displaceable working platform having an extensible boom, and more particularly, to a mine working platform which is displaceable along a mine shaft and secured immovably at a desired position in the mine shaft with the extensible boom extending at a desired angle thereto so as to be extended into a working area which is progressively bored in a secondary shaft usually at an angle to the mine shaft.

2. Description of Prior Art

Various apparatuses are known for use in mine shafts to effectuate the boring of shafts or to drill holes in the walls of mine shafts. Such apparatus is, for example, described in Canadian Patent 989,814 issued on May 25, 1976. Such devices can be operated locally or remotely and are used to bore into mineral veins in a direction forwardly of the vehicle. The above-described Patent relates to a self-propelled drilling rig for boring blast holes and small diameter wells and as the well is excavated, the rig moves in the direction of excavation. A disadvantage of such rigs is that the rigs must be pulled out and repositioned in the well each time it effectuates a task. Also, the main frame is usually positioned very close to the drilling rig and this can be hazardous to a person working in close proximity to the rig, particularly in mine shafts where the support where the floor of the shaft is at an angle and often slanted sideways and strewen with debris. Also, the apparatus as defined in this Patent shows the jig manipulator mounted on a carriage which provides for only a small travel extension of the drilling tool and accordingly it is necessary to displace the main frame each time a small distance has been bored. This is very time-consuming and costly and also hazardous to the mine workers.

It is therefore desirable to provide a machine which supports a mine worker or a mine working tool over long distances in mine shafts or along excavated veins disposed transversely to mine galleys and wherein the working implement can be easily and qwuickly retracted from the excavating tunnel without having to displace the main support frame each time the tool is retracted and repositioned.

Telescopic booms which are secured to turret type bases and articulated thereon are also known in the crane design art, such as disclosed in Canadian Patent 2,000,107. However, like the prior art referred to above, a disadvantage of such design is that the boom is pivotally fixed to the main frame and restricted thereby. The boom is connected to work primarily in the forward direction of the frame for the reason that the counterweight is provided in the rear end of the frame and the anchoring can only be effectuated in the rear end so as to be out of the way of the boom displacement area. For this reason, such cranes have imposed limitations on the angular displacement of the boom, particularly in the lateral plane at an angle to the long axis of its support frame. The apparatus of the above-referred to Canadian Patent is accordingly utilized to work primarily in the forward direction of its support frame or vehicle frame and accordingly must be displaced in the tunnel where a work function is to be performed.

SUMMARY OF INVENTION

It is a feature of the present invention to provide a displaceable working platform, and particularly, a mine working platform, which can be immovably secured to surrounding surfaces and which is provided with a telescopic boom secured to a displaceable platform which is slidable outwardly of the main frame and wherein the boom can be articulated and extended along axes or drilling shafts positioned at angles and transversely to a mine gallery or mine shaft and extended for long distances along such angles to follow a vein being excavated and extending in opposed direction to the said gallery where the main frame is immobilized.

Another feature of the present invention is to provide a displaceable mine working platform having a main frame with stabilizing anchor means permitting the main frame to be anchored rigidly within the mine shaft, regardless of the angle of the shaft and the lateral slope of the floor, and which permits its extensible boom to be extended and retracted over long distances within drilling shafts extending at various angles to the gallery with the main frame being rigidly anchored within the gallery.

According to the above features, from a broad aspect, the present invention provides a displaceable working platform comprising a main frame having stabilizing means for immovably securing the main frame to at least two opposed surrounding surfaces. A displaceable platform is slidingly secured to the main frame. Adjustable displacement means is provided for displacing the platform from a storage position to a working position relative to the main frame. An extensible boom is secured on a rotating support base secured to the displaceable platform. The boom has a working free end with a working element secured thereto. Means is provided to rotate the boom on the rotating support base. Means is further provided to control the extension of the boom. Still further, means is provided to regulate the angular position of the boom.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
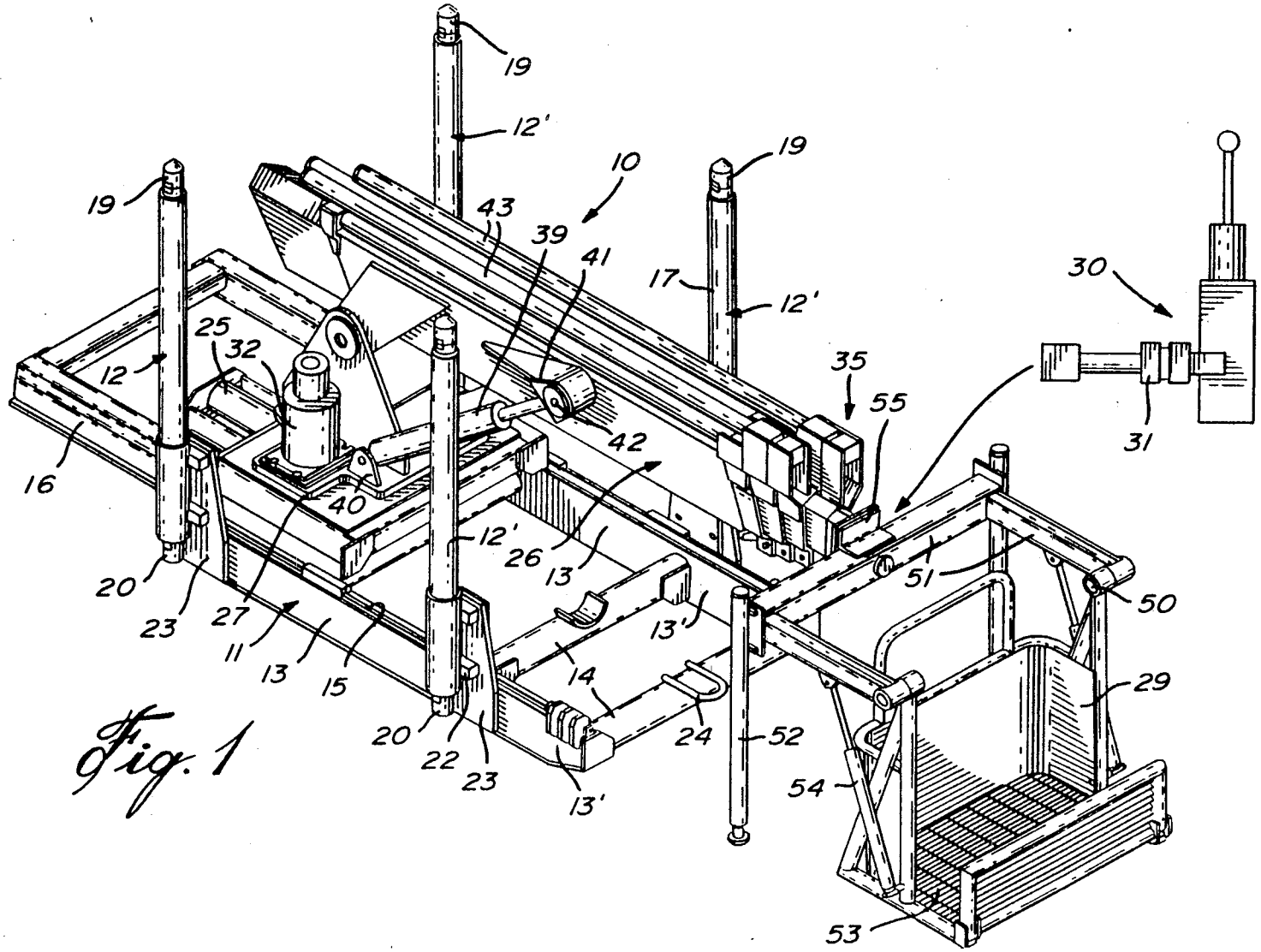
FIG. 1 is a perspective view of the displaceable mine working platform of the present invention with the displaceable platform disposed at a storage position with its boom retracted.

Referring now to the drawings, and more particularly to FIGS. 1 and 7A to 7C, there is shown generally at 10 the displaceable mine working platform of the present invention. As herein shown, the platform comprises a main frame 11 having stabilizing means in the form of eight telescopic extension posts 19 and 20, herein one pair of posts 19 and 20 secured in a respective one of four hydraulic cylinder housings 12 secured in respective corners to the outside of the main frame and namely to a pair of a displacement support skid beams 13. The skid beams are secured in spaced apart parallel relationship by transverse structural frame members 14. The skid beams 13 are provided with guide means, herein a guide rail mechanism 15 in an upper edge thereof. A displaceable platform 16 is secured and supported on the guide rail mechanism 15 to move axially of the main frame.

Figure 3:
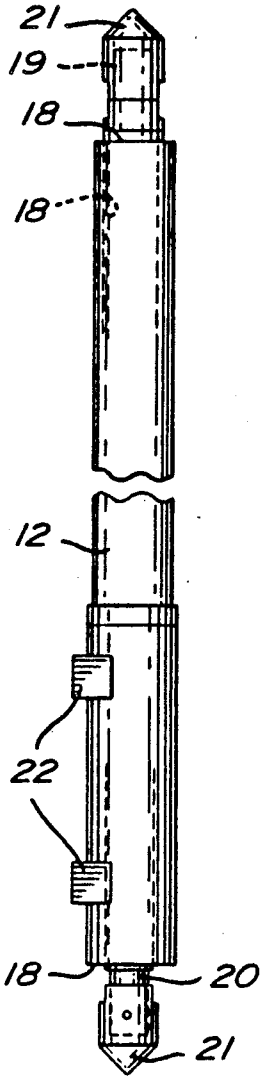
FIG. 3 is a side view showing the construction of the telescopic stabilizing extension posts.

Each of the hydraulic cylinder housings and telescopic extension posts 19 and 20 are better illustrated in FIG. 3 and are comprised of a cylindrical housing 12 having opposed telescopic hydraulic extendible posts 19 and 20 received therein and independently extendible from opposed end 18 of the 12. The hydraulic posts 18 and 19 also have a pointed conical end caps 21 whereby to engage in a rock surface, usually the flooring and ceiling surfaces of a mine shaft. The end caps 21 are in threaded engagement with the end of the posts 19 and 20. A bracket 22 secures the cylindrical housing 12 to securing plates 23 welded to the skid beams 13.

The skid beams 13 constitute displacement support means for the main frame and the frame is provided with hooks 24 at opposed ends thereof whereby the working platform can be towed to a desired position along a mine shaft.

Figure 2:
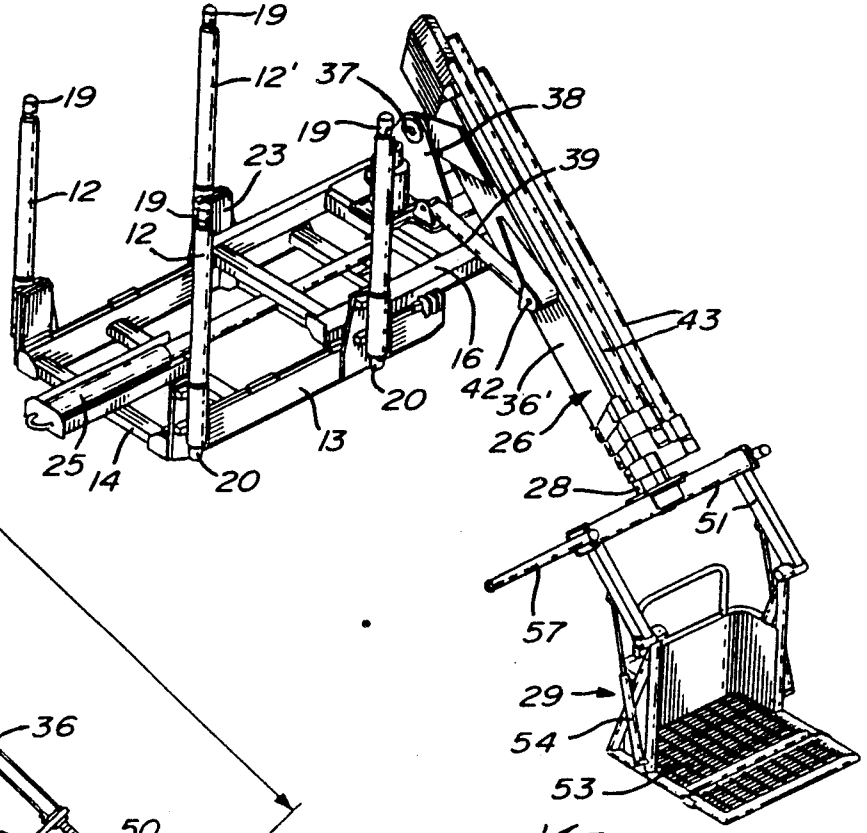
FIG. 2 is a further perspective view of the displaceable mine working platform of the present invention with the displaceable platform disposed at a working position and the extensible boom disposed at a transverse direction and angulated therefrom.

The displaceable platform 16, as better shown in FIG. 2, is secured to the guide rails 15 by suitable means well known in the art so that the displaceable platform is rigidly secured to the main frame at any position between its storage position, as shown in FIG. 1 to its position of use, as shown in FIG. 2. Adjustable displacement means in the form of telescopic hydraulic cylinder 25 is secured to the main frame. The free end of the telescopic piston rod 25 is secured to the displaceable frame and by suitable hydraulic controls (not shown) the extension position of the piston rod 25 is controlled to position the displaceable platform along the guide rails 15. The displacement means can also be constituted by a chain drive, well known in the art.

As shown in FIGS. 1 and 2, an extensible boom 26 is secured on rotating support base 27 which is secured to the displaceable platform 16. The boom 26 is provided with a working free end 28 to which is secured a working element such as the working platform 29 as herein shown. A drill 30 may be substituted for the working platform 29 or any other working tool, as herein shown, the drill is provided with an articulated joint 31 and suitable motors and connections whereby to control the position of the drill from a far end by a control system provided with the main frame, and not shown herein.

Figure 6:
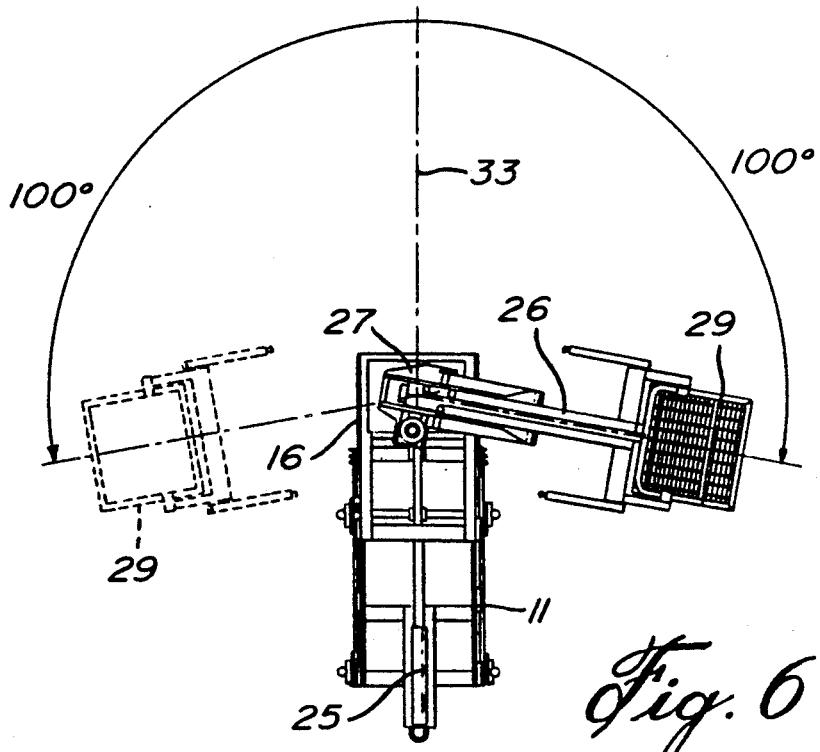
FIG. 6 is a top view showing the maximum lateral or horizontal angular displacement of the boom.
Figure 7A:
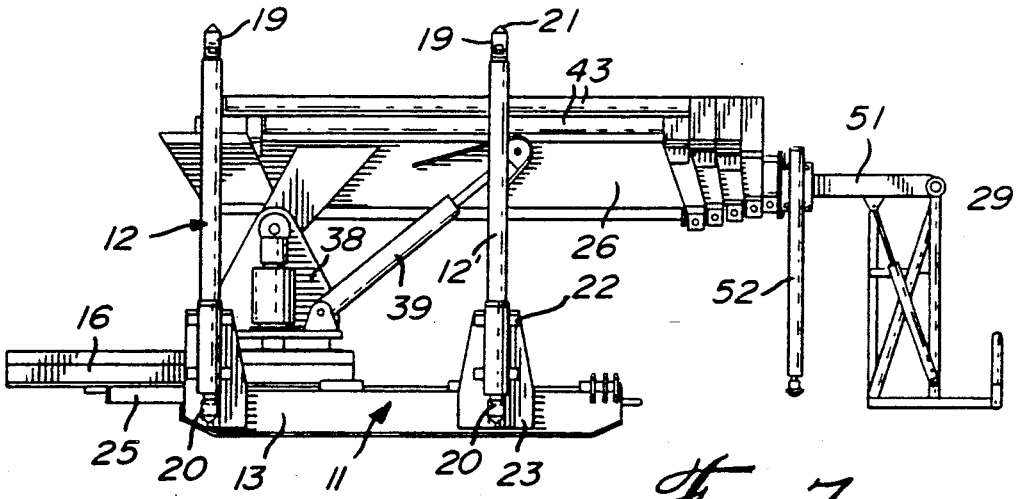
FIGS. 7A, 7B and 7C are side, top and end views, respectively, of the mine working platform of the present invention.
Figure 7B:
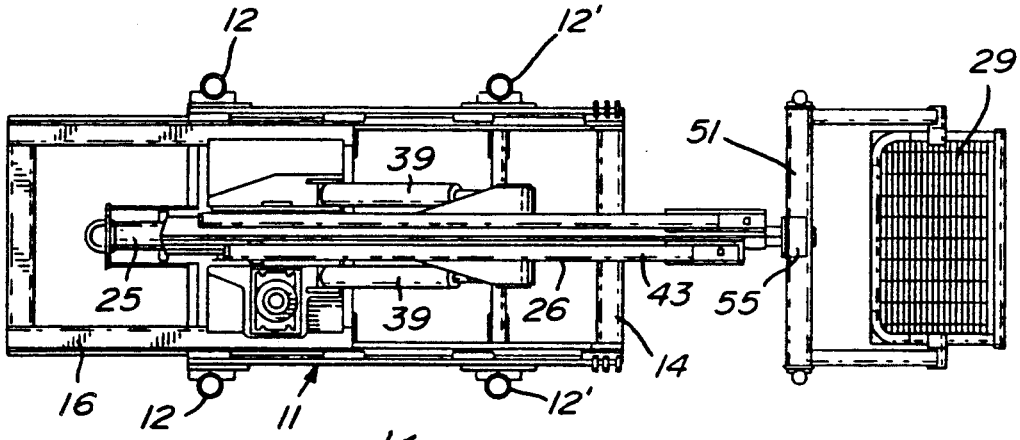
Figure 7C:
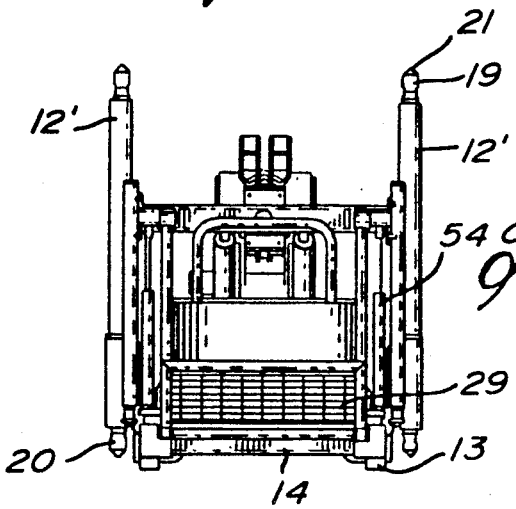

A gearing motor 32 is gear coupled to the displaceable platform whereby to rotate the rotating support base to position the boom at an angle laterally of the displaceable frame or of the long axis 33 of the working platform in a horizontal plane, as shown in FIG. 6. As herein shown, the boom is displaceable along an arc of 100° to each side of the long axis 33, thereby providing for the working element to be positioned in directions transversely of the main shaft in which the main frame is immovably secured.

Figure 5:
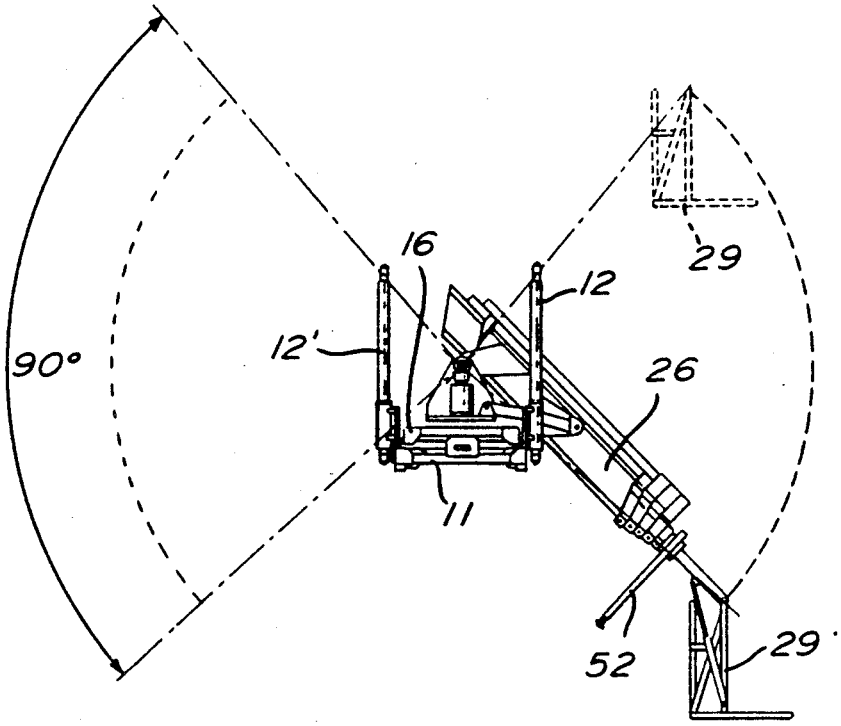
FIG. 5 is a front view showing the transverse working angles of the boom on either side of the main frame.

As shown in FIG. 5, the boom is also extensible at angular vertical positions up to approximately 45° above and below the horizontal plane of the main frame. Accordingly, the working element can not only be positioned in lateral bore holes or tunnels with respect to a main shaft, but in tunnels extending at abrupt angles upwardly or downwardly of the main shaft. Furthermore, the working element can be displaced in a vein being bored and transversing a main mine gallery, from opposed sides of the gallery at practically any angle thereto.

As can also be seen from FIG. 1, the extension post 12' positioned near the working end section 35 of the main frame are spaced inwardly from the end portions 13' of the skids so as to provide for better support of the displaceable platform 16 when at its working position with the platform 16 extended.

As can be seen more clearly from FIGS. 1, 4, 7A and 7B, the extensible boom 26 is telescopic and comprised of a plurality of straight boom sections 36 disposed one within the other. The outer one or larger one of the sections 36' is pivotally secured on pivot connection 37 between a pair of support flanges 38 which extend in parallel transverse relationship above the support base 27. One or more, herein two hydraulic pistons 39, are secured between the rotating support base 27 and at a predetermined location on both sides of the to outer one of the boom sections 36'. As herein shown, the rear end of the cylinder 39 is pivotally secured on pivot bracket 40 to the rotating support base 27 and its piston rod end 41 (see FIG. 7A) is secured by a pivot pin 42 to the outer boom section 36'. Accordingly, the boom can be articulated on its pivot connection 37 within the displacement arcs, as shown in FIG. 5.

Figure 4:
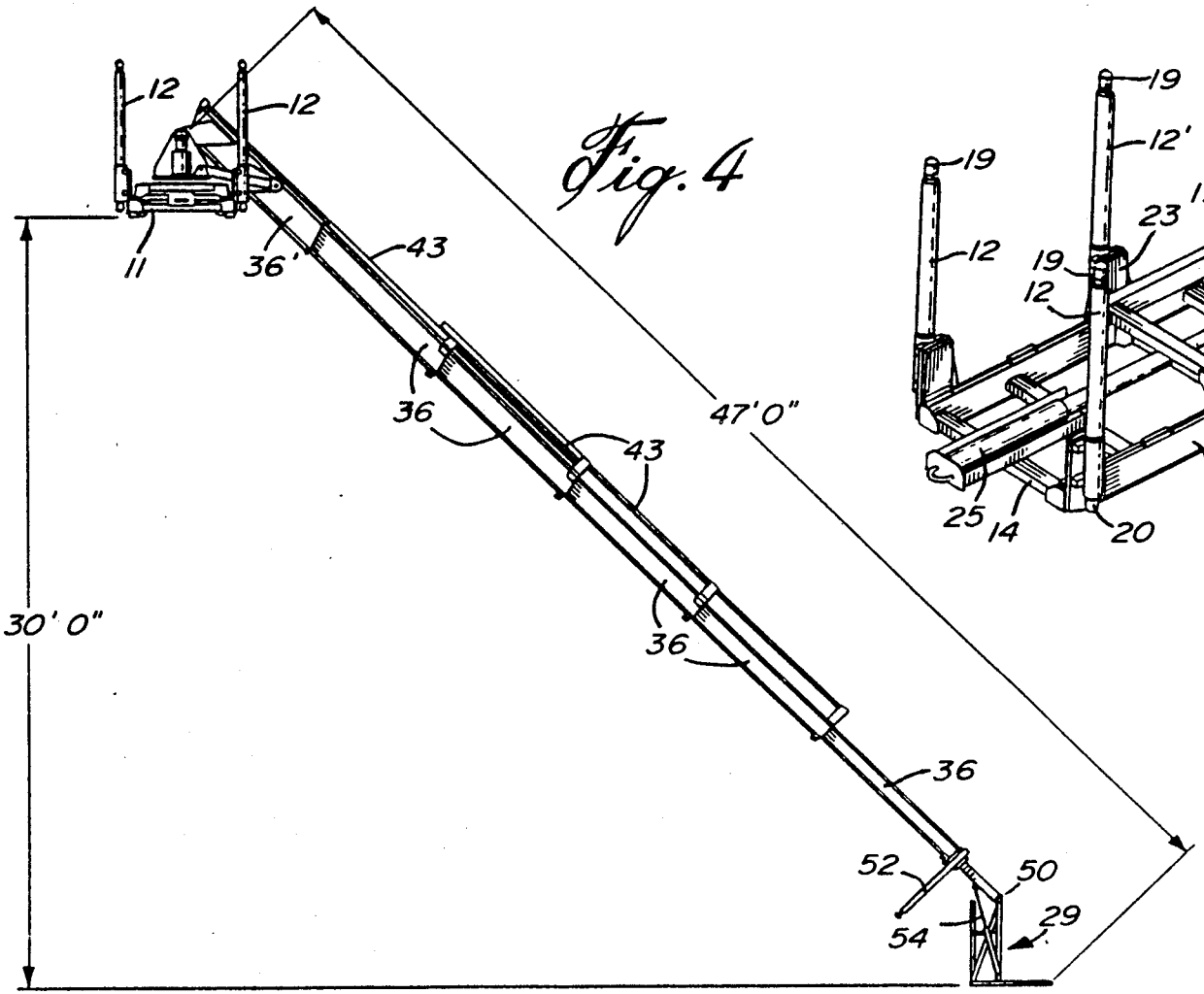
FIG. 4 is an end view of the mine working platform showing the extensible boom in its maximum extended position and at its maximum transverse angle.

Each of the boom sections 36 are connected to one another by hydraulic pistons 43 which are controlled by a hydraulic system, not shown, but obvious to a person skilled in the art with the pistons being connected in parallel to one another whereby each boom section 36 is extensible a substantially equal amount from within one another. This provides for maximum rigidity and loading of the boom as it is extended. In its full extension, as shown in FIG. 4, the boom of the particular embodiment described herein is extensible up to a distance of 47 feet. At a maximum angle to the main frame, i.e. an angle of 45° from the horizontal, the working element 29 can be positioned along a transversely angulated shaft to a distance of about 30 feet below or above the main shaft. It is pointed out that the mine working platform of the present invention can self-displace itself in a main shaft by attaching a cable to the connecting loops 24 at either end of the main frame and actuating the cable by a winch. Alternatively, the cable could be actuated by the displaceable platform itself by moving the platform along the guide rails of the skid beams. Alternatively, the skid beams may be ordinary frame members and these could be supported on motorized ground engaging means such as endless tracks or wheels (not shown). It is also pointed out that the arresting rods extension posts 18 and 19 are controlled by the mine worker either from the working platform 29, with suitable controls provided therewith, or remotely from the main frame. Such remote controls are obvious to a person skilled in the art and the controls could be either electrical, wireless, or hydraulic/pneumatic.

As shown in FIG. 1, the working platform 29 is hingedly secured by hinge connections 50 to a U-shaped structural frame 51. Stabilizing jacks 52 are secured to opposed sides of the frame 51 and are preferably hydraulically controlled by the operator standing on the floor 53 of the platform 29. Accordingly, as the platform is advanced to a desired position in a shaft to effectuate a work function such as a bore hole function, the operator controls the advancement of the extensible boom 26 until he reaches a desired location within the shaft. He then actuates the stabilizing jacks 52 to support the platform 29 on a surface of the shaft. Accordingly, the jacks 52 are preferably independently controlled as the flooring of the shaft is obviously not horizontal. These support jacks relieve the loading on the extensible boom 26 and also stabilize the platform 53 for the mine worker to position and support the drill tool on this platform. The platform 53 is also made adjustable by further hydraulic cylinders 54 secured thereto and to the frame 51 to brace the platform with the frame at a desired angle depending on the nature of the support flooring. The connection 55 may also be an articulated joint which is also hydraulically controlled or mechanically controlled should it be desired to articulate the platform at any angle relative to the end of the boom. Other obvious modifications of the mine working platform are intended to be covered by the specification provided such modifications fall within the scope of the appended claims.

Figure 8:
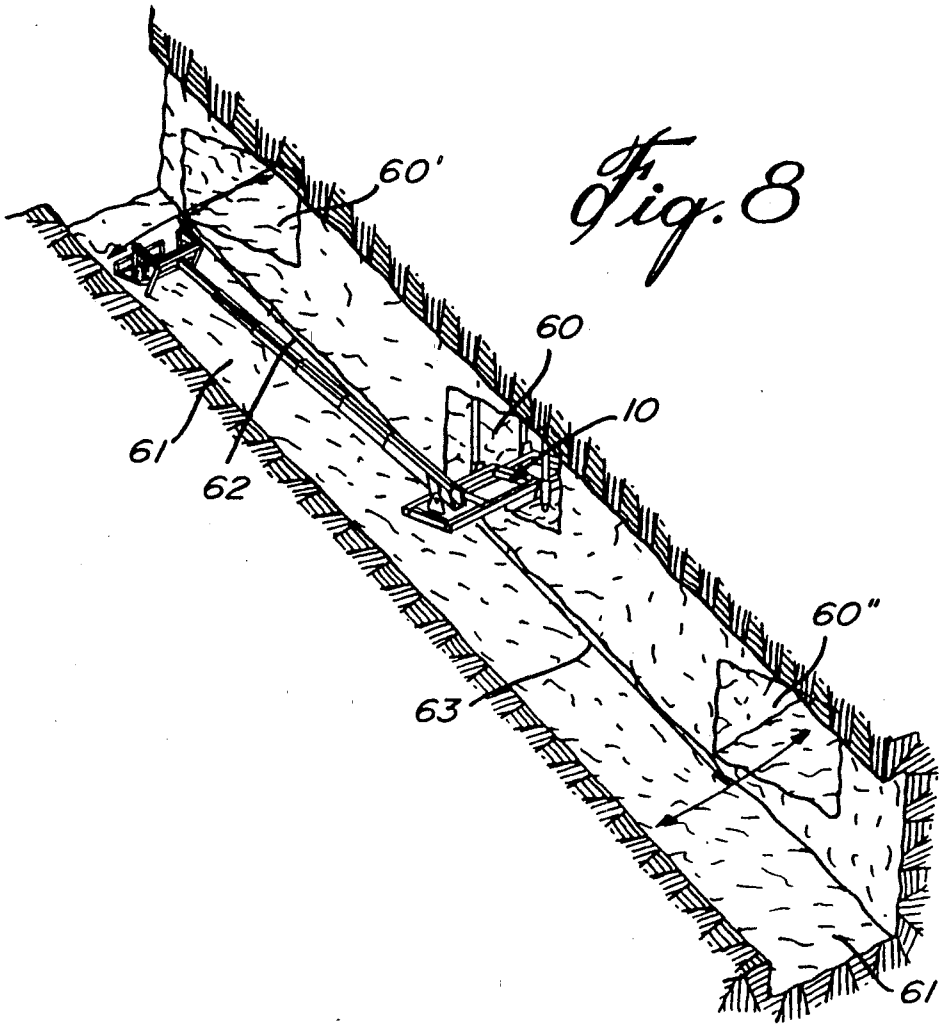
FIG. 8 is a schematic view illustrating the use of the mine working platform for excavating a vein disposed transverse and at an angle to a plurality of mine galleries.

With reference to FIG. 8, it can be appreciated that with the mine working platform 10 of the present invention, it makes it possible to orient the working platform along a desired mine gallery 60 adjacent a transverse vein 61 which is to be excavated. The boom is then displaced to excavate the entire transverse surface area of the vein 61 in a first direction such as indicated by arrow 62 until the boom has reached its maximum extensible length. This extensible length is such as to permit the vein to be excavted to the next adjacent gallery 60' in most mine tunneling configurations. Without displacing the main frame, it is then possible to excavate the vein in the opposed direction of the gallery 60 as indicated by arrow 63 and up to the next adjacent gallery 60''. Accordingly, with the mine working platform of the present invention, it is possible to excavate longer distances in veins thereby permitting the excavation of fewer galleries having greater from one another. Where galleries are already excavated at close spacing, it is possible to position the mine working platform at every second gallery only in order to excavate a vein.

Another important advantange of the mine working platform of the present invention is that the platform can be oriented horizontally in galleries in which the floor of the gallery is slanted as there is provided four telescopic independently controlled extension posts in spaced apart relationship to rigidly and immovably secure the main frame and skid beams within the gallery. As previously described, the displaceable platform is extended partially outside the main frame to position the rotating support base free of obstruction by the anchoring extension posts 18 and 19 and to permit the arcuate displacement of the boom within the wide angular ranges both in the vertical or horizontal planes or at intermediate positions thereof, as described hereinabove. The working platform 29 can also be braced both vertically or laterally by the stabilizing jacks 52 and the anchor rods 57.

We claim:

1. A displaceable working platform comprising a main frame having stabilizing means for immovably securing said main frame to at least two opposed surrounding surfaces, a displaceable platform slidingly secured to said main frame, adjustable displacement means for displacing said platform from a storage position to a working position relative to said main frame, an extensible boom secured on a rotating support base secured to said displaceable platform, said boom having a working free end, a working element secured to said free end, means to rotate said boom on said rotating support base, means to control the extension of said boom and means to regulate the angular position of said boom.

2. A displaceable working platform as claimed in claim 1 wherein said working platform is a mine working platform, said stabilizing means comprises a plurality of telescopic extension posts secured to said main frame and extending transversely to a horizontal plane thereof for engagement with a floor and ceiling portion of a mine shaft, said extensión posts being independently adjusted to control the angular position of said main frame relative to said floor of said mine shaft.

3. A displaceable mine working platform as claimed in claim 2 wherein said main frame is a rectangular frame, there being two pairs of telescopic extension posts secured on a respective side of said frame, each post having an extensible arresting rod at opposed ends thereof.

4. A displaceable mine working platform as claimed in claim 3 wherein each said arresting rods has pointed conical ends for engaging in a rock surface of said mine shaft floor and ceiling, said arresting rod being housed in a telescopic manner in an hydraulic cylindrical housing and independently extendible from opposed ends of said cylinders housing.

5. A displaceable mine working platform as claimed in claim 3 wherein said main frame is further provided with displacement support means for moving said frame along said mine shaft.

6. A displaceable mine working platform as claimed in claim 5 wherein said displacement support means is comprised by a pair of skid beams secured in spaced parallel relationship by transverse structural frame members, said skid beams each having a guide rail mechanism in an upper part thereof, said displaceable platform being secured and supported on said guide rail mechanism.

7. A displaceable mine working platform as claimed in claim 6 wherein said adjustable displacement means is a telescopic hydraulic cylinder secured to said main frame and having a telescopic rod end secured to said displaceable frame for moving said displaceable frame to a desired position axially along said guide rail mechanism.

8. A displaceable mine working platform as claimed in claim 6 wherein two of said extension posts are spaced from a working end section of said main frame, said displaceable platform when at said working position extending at least partially outwardly of said working section with said rotating support base disposed outwardly of said two of said extension posts to permit said boom to be displaced laterally of said main frame.

9. A displaceable mine working platform as claimed in claim 8 wherein said extensible boom is comprised of a plurality of straight boom sections disposed one within the other, an outer one of said boom sections being pivotally secured at a rear end portion to a boom support frame secured to said rotating support base, said means to regulate the angular position of said boom being constituted by one or more pistons secured between said rotating support base and said outer one of said boom sections, said means to rotate said boom on said rotating support base being a reduction gearing motor.

10. A displaceable mine working platform as claimed in claim 9 wherein said means to control the extension of said boom comprises a hydraulic system connected to an associated piston of each said boom sections, said pistons being connected in parallel in said hydraulic system whereby each boom section is extensible a substantially equal amount from within one another.

11. A displaceable mine working platform as claimed in claim 9 wherein said bom is laterally rotatable on said rotating support base over an arc of about 100° to each side of the central longitudinal axis of said main frame, said boom also being angularly positionable up or down to an angle of approximately 45° above and below the horizontal axis of said main frame.

12. A displaceable mine working platform as claimed in claim 5 wherein said working element is a working platform for supporting a person thereon, said working platform having stabilizing jacks secured thereto to stabilize said working platform at a working location spaced from said displaceable platform.

13. A displaceable mine working platform as claimed in claim 12 wherein said working platform is hingedly secured to a platform structural frame, one or more hydraulic pistons for controlling the angular position of said working platform relative to said frame, said stabilizing jacks being secured to said structural frame and being hydraulically controlled by a person occupying said working platform; and controls for operating said telescopic boom, said rotating support base and displacement means to move said working platform from said storage position to said working position.

14. A displaceable mine working platform as claimed in claim 5 wherein said working implement is a remotely operable tool secured to a support frame at said boom free end, said tool being controlled by an operator at said main frame.

15. A displaceable mine working platform as claimed in claim 5 wherein said displacement support means is constituted by motorized ground engaging means.

* * * * *